US009079325B2

(12) United States Patent
Corcoran

(10) Patent No.: US 9,079,325 B2
(45) Date of Patent: Jul. 14, 2015

(54) CHEMICAL-ETCHED DIE HAVING IMPROVED REGISTRATION MEANS

(75) Inventor: Kevin L. Corcoran, Mission Viejo, CA (US)

(73) Assignee: Ellison Educational Equipment, Inc., Lake Forest, CA (US)

( * ) Notice: Subject to any disclaimer, the term of this patent is extended or adjusted under 35 U.S.C. 154(b) by 255 days.

(21) Appl. No.: 13/533,074

(22) Filed: Jun. 26, 2012

(65) Prior Publication Data

US 2013/0014621 A1 Jan. 17, 2013

Related U.S. Application Data

(60) Provisional application No. 61/572,672, filed on Jul. 15, 2011.

(51) Int. Cl.

| | |
|---|---|
| ***B26F 1/42*** | (2006.01) |
| ***B26F 1/44*** | (2006.01) |
| *B26F 1/46* | (2006.01) |

(52) U.S. Cl.
CPC ... *B26F 1/44* (2013.01); *B26F 1/42* (2013.01); *B26F 1/46* (2013.01); *Y10T 83/0405* (2015.04); *Y10T 83/9423* (2015.04)

(58) Field of Classification Search
CPC ..... B26F 1/42; B26F 1/44; B26F 1/46
USPC ..... 83/686, 531–541, 55
See application file for complete search history.

(56) References Cited

U.S. PATENT DOCUMENTS

| | | | | |
|---|---|---|---|---|
| 3,872,744 | A * | 3/1975 | Fauth | 76/107.8 |
| 4,796,501 | A * | 1/1989 | Hagmann | 83/535 |
| 5,255,587 | A * | 10/1993 | Eichenberg et al. | 83/628 |
| 6,626,965 | B2 * | 9/2003 | Corcoran et al. | 83/856 |

FOREIGN PATENT DOCUMENTS

WO WO-8300112 A1 * 1/1983

* cited by examiner

*Primary Examiner* — Stephen Choi
(74) *Attorney, Agent, or Firm* — Morland C. Fischer

(57) ABSTRACT

A chemical etched die to be used in combination with a (e.g., roller) press to cut out shapes that are printed on sheet material. The die includes an outside border that surrounds an inside opening through the die. The size of the inside opening corresponds to the size of the shape to be cut. A cutting edge (i.e., blade) projects from the outside border of the die so as to surround the inside opening therethrough. The cutting edge is positioned at the interface of the outside border and the inside opening of the die whereby none of the outside border extends past the cutting edge and none of the outside border lies between the cutting edge and the inside opening. Accordingly, the cutting edge of the die will be exactly registered with the printed shape to be cut when the shape is surrounded by the outside border of the die.

3 Claims, 5 Drawing Sheets

CHEMICAL-ETCHED DIE HAVING IMPROVED REGISTRATION MEANS

CROSS REFERENCE TO RELATED APPLICATIONS

This application is related to Provisional Patent Application No. 61/572,672 filed Jul. 15, 2011.

BACKGROUND OF THE INVENTION

1. Field of the Invention

This invention relates to a chemical-etched die of the kind to be used in combination with a (e.g., roller) press to produce die cut shapes from a sheet material. The die has a cutting edge which can be precisely registered by the user in alignment with a pattern that is printed on the sheet material from which the shapes are to be cut.

2. Background Art

Dies have long been used by educators, marketing professionals, and those in the arts and crafts industry to produce a wide variety of shapes and designs that are cut from sheet material in response to a force that is generated by a die press and applied to the dies to push cutting edges (i.e., blades) of the dies through the sheet material. Reference can be made to U.S. Design Pat. Nos. D607,910 and D585,081 for examples of hand-operated and motorized roller press machines which are adapted to accept one or more dies to cut through sheet material.

In some cases, a particular pattern to be die cut is printed on the sheet material. The user typically tries to align the cutting blade of the die with the printed pattern on the sheet material. If the alignment is accurate and the die and sheet material are run together through the press, a precise shape corresponding to the printed pattern will be cut from the material. However, if the user cannot see the cutting blade or know its exact location on the die, the die may not be properly registered with the printed pattern. Consequently, the die cut shape may not be as precise as intended.

Reference can be made to U.S. Pat. No. 7,055,427 for an example of a chemical-etched die that may be subject to the registration problem described above when the die is laid over a sheet material and run through a press.

SUMMARY OF THE INVENTION

A chemical-etched die is disclosed to cut out shapes from a sheet of material when the die and sheet material are moved together through a (e.g., roller) press. The die includes a flat outside border that surrounds an inside opening through the die which defines the shape to be cut from the sheet material. A thin cutting edge (i.e., blade) projects from the outside border to extend around the inside opening through the die. The cutting edge is pushed through the sheet material in response to a compressive force generated by the die press and applied to the die. As an important feature, the cutting edge surrounds the inside opening of the die such that none of the outside border lies between the cutting edge and the inside opening. That is to say, the cutting edge lies exactly at the periphery of the inside opening through the die so as to precisely define the shape to be cut from the sheet material. To stabilize the die against twisting and changing its shape when subjected to the force generated by the die press, the outside border is provided with a width of at least 2.5 mm.

By locating the cutting edge exactly at the periphery of the inside opening, the user will know the location of the cutting edge when the die is turned upside down and laid against the sheet material. By virtue of the foregoing, the user will be able to accurately register the cutting edge of the die with a pattern that is printed on the sheet material to be cut. Thus, the shape is cut from the sheet at its intended location corresponding to the location of the pattern printed thereon.

DESCRIPTION OF THE PREFERRED EMBODIMENT

Figure 1:
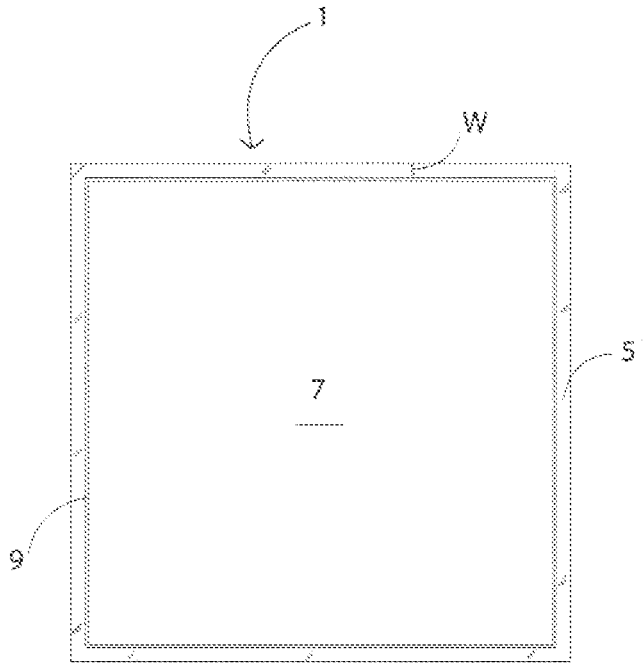
FIG. 1 is a top view showing one example of a chemical-etched die having the improved registration means of the present invention.
Figure 2:
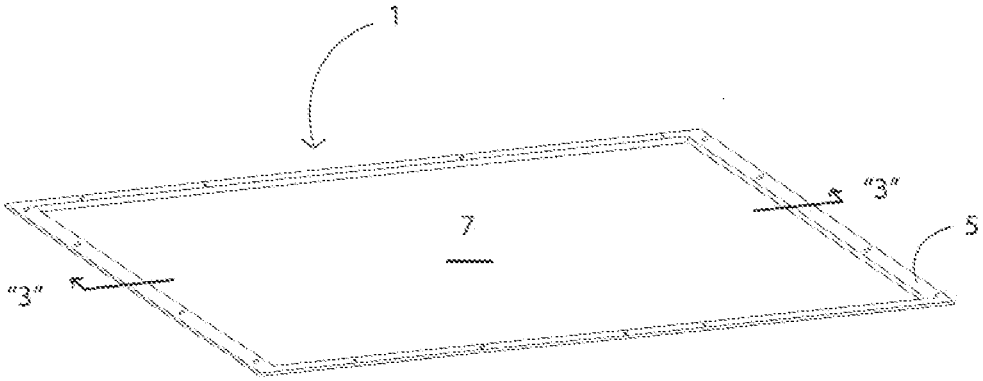
FIG. 2 is a bottom perspective view of the die shown in FIG. 1 having a cutting edge located at the periphery of an inside opening through the die to achieve the advantages of this invention.
Figure 3:
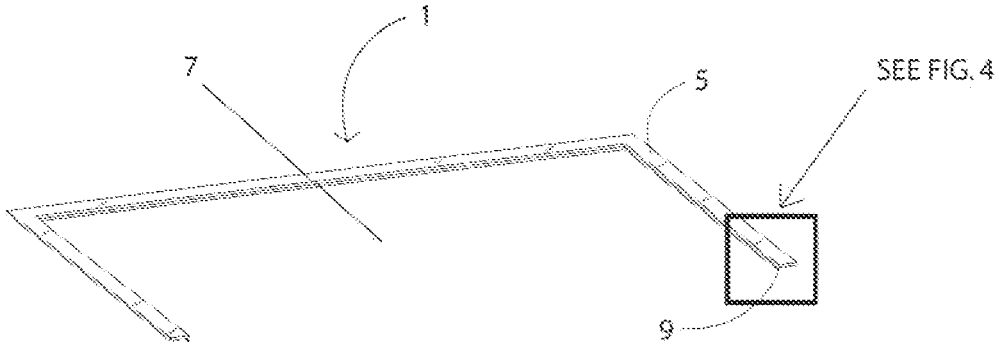
FIG. 3 is a cross-section of the die taken along lines 3-3 of FIG. 2.
Figure 5:
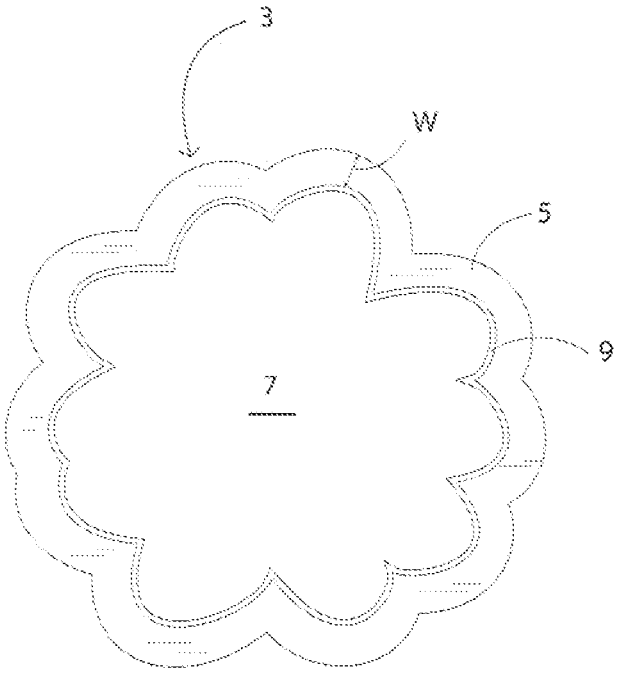
FIG. 5 shows another example of a chemical-etched die having the improved registration means.
Figure 6:
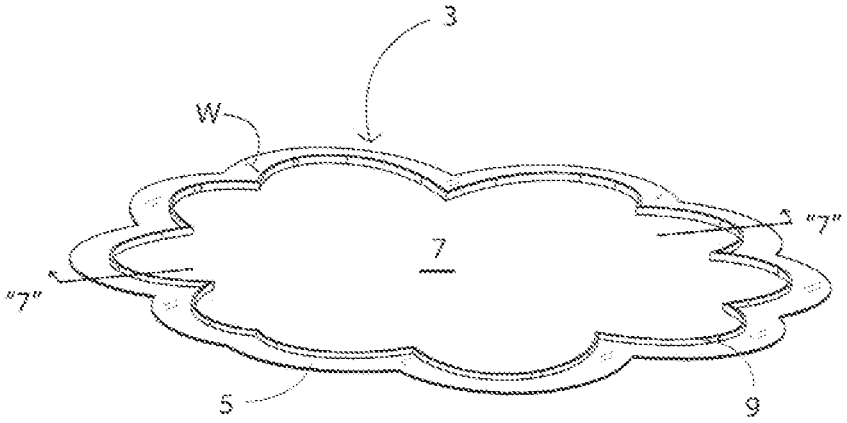
FIG. 6 is a top perspective view of the die shown in FIG. 5 having a cutting edge located at the periphery of an inside opening through the die to achieve the advantages of this invention.
Figure 8:
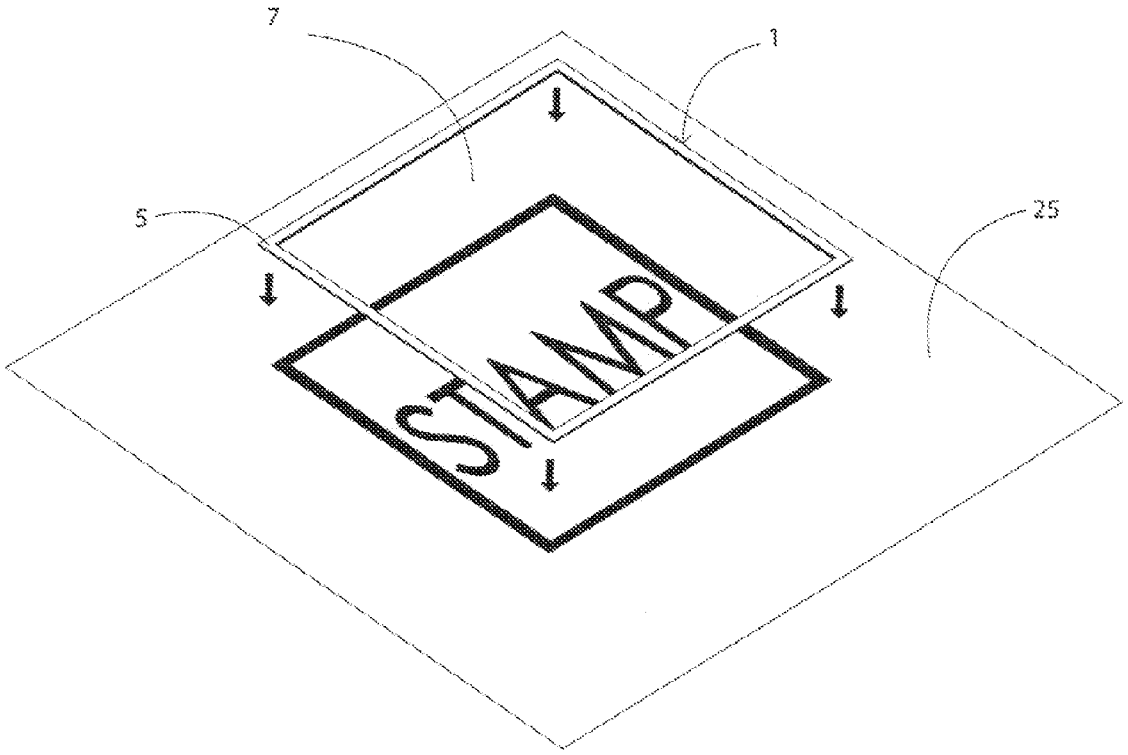
FIG. 8 shows the die of FIG. 1 being moved towards a sheet material so that the cutting edge of the die will be accurately registered with a shape to be cut from the sheet material.
Figure 10:
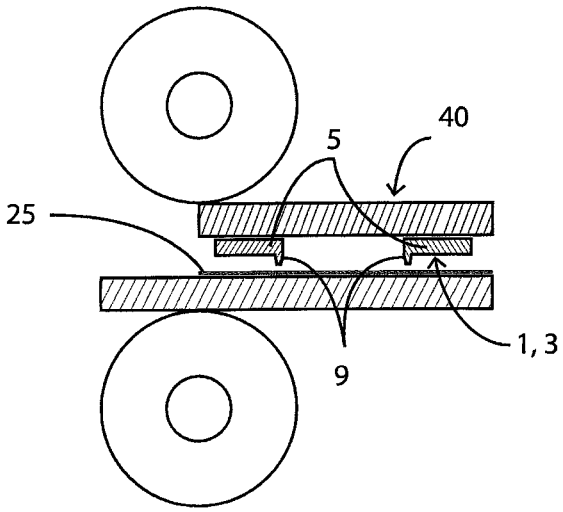
FIG. 10 shows a roller press in which the die and sheet material of FIG. 8 are positioned after the die has been registered with the shape to be cut from the sheet material.

Referring initially to FIGS. 1 and 5 of the drawings, two examples are shown of chemical-etched dies 1 and 3 to be used in combination with a die press (e.g., a roller press) in order that shapes can be cut out of a suitable sheet material made from paper, plastic, thin metal, or the like (designated 25 and best shown in FIG. 8). In this regard, FIG. 10 of the drawings shows a conventional roller press 40 that is suitable to accommodate either one of the dies 1 or 3 and the sheet material 25 having a shape to be cut therefrom. The dies 1 and 3 are preferably manufactured from flat steel that is treated by a conventional chemical etching process. The shapes of the dies 1 and 3 (which correspond to the shapes to be cut from the sheet material) can vary among different designs, symbols, letters, numbers, etc. to suit the needs of the user. In the examples of FIGS. 1 and 5, the chemical-etched die 1 has the shape of a square or window, and the chemical-etched die 3 has the shape of a flower. However, the precise shape of the dies 1 and 3 is not to be considered as a limitation of this invention.

Each of the dies 1 and 3 of FIGS. 1 and 5 has a flat outside border 5 that surrounds an inside opening 7 through the die. The die cut shape to be cut from the sheet material matches the shape (e.g., a square or a flower) of the inside opening 7 through the die 1 or 3. As is best shown in FIGS. 2-4, 6 and 7, a thin cutting edge 9 projects outwardly from the top of the outside border 5 of each die 1 and 3 around the inside opening 7 thereof. The cutting edge 9 provides a blade that is capable of cutting through the sheet material in response to a compressive force generated by the press into which the die is installed.

Figure 4:
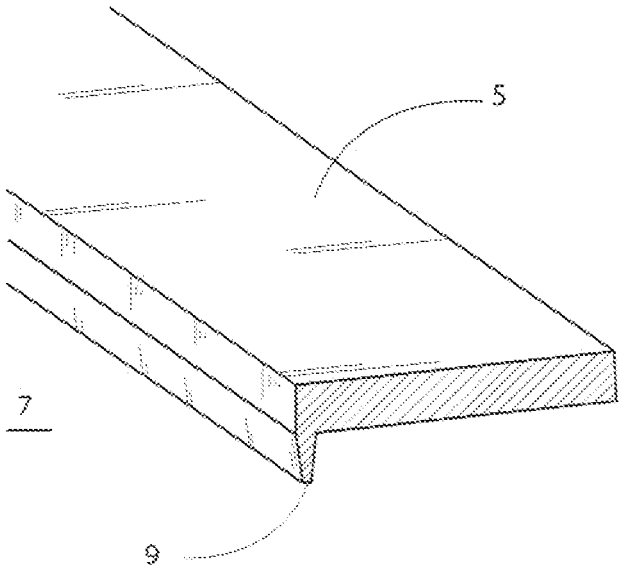
FIG. 4 is an enlarged detail of the cutting edge of the die taken from FIG. 3.
Figure 7:
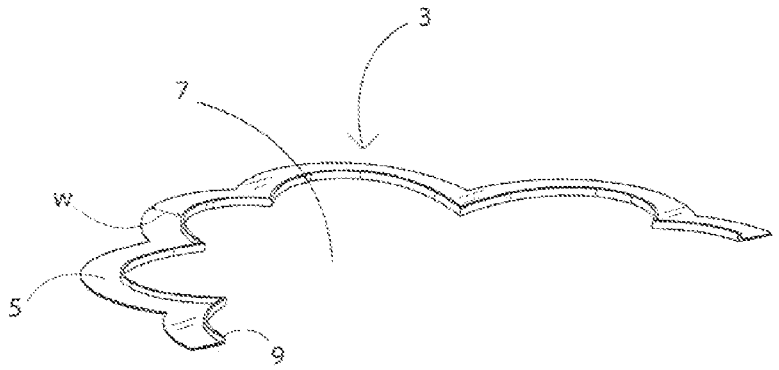
FIG. 7 is a cross-section of the die taken along lines 7-7 of FIG. 6.

In accordance with an important feature of the present invention, the cutting edge 9 of each die 1 and 3 is located at the interface of the outside border 5 with the inside opening 7. As is best shown in FIGS. 4 and 7, the cutting edge 9 surrounds the inside opening 7 such that none of the outside border 5 extends inwardly past the cutting edge 9 and none of the outside border 5 lies between the cutting edge 9 and the inside opening 7. In other words, the cutting edge 9 lies exactly at the periphery of the inside opening 7 of the dies 1 and 3 so as to precisely define the shape represented by the inside opening to be cut from the sheet material.

Because the outside border 5 of the dies 1 and 3 lies entirely to one side (i.e., the outside) of the cutting edge 9, the outside border 5 must have a sufficient width (designated W in FIGS. 1 and 5) to prevent the die from twisting and changing its shape when subjected to a compressive force generated by the die press in which the die is used. That is to say, the size (i.e., width) of the outside border is chosen so that all sides of the die 1 or 3 will be balanced and maintain shape stability as the die moves through the press below the force-generating means thereof. To this end, it is preferable that the width W of the outside border 5 which surrounds the inside opening 7 of dies 1 and 3 be at least 2.5 mm so that the original shape of the dies will not change under pressure in order to ensure that correspondingly accurate shapes are cut from the sheet material. The width W of the outside border 5 increases as the size of the die increases.

By virtue of locating the cutting edge 9 of the dies 1 and 3 exactly at the periphery of the inside opening 7, the user will know the location of the cutting edge 9 when the die is laying on the sheet material and the cutting edge is forced through the sheet material to cut a shape therefrom as the die and sheet material move together through the press. Referring in this regard to FIG. 8 of the drawings, in order to cut a shape, the die (e.g., 1) is turned upside down with respect to its position shown in FIG. 1 so that the cutting edge 9 which extends from the top of the outside border 5 and which now faces the sheet material 25 will be invisible to the user. Since the location of the cutting edge 9 follows exactly the periphery of the inside opening 7 through the die which at all times remains visible to the user, the location of the cutting edge 9 will be correspondingly known.

The advantage of knowing its location is especially important when the user wishes to closely align or register the cutting edge 9 of the die 1 or 3 with a pattern that is printed on the sheet material 25 to be cut. In this same regard, some conventional dies have a cutting edge which lies on a border that runs around an opening, whereby the border extends to opposite sides of the cutting edge and the cutting edge is spaced outwardly and away from the opening. In this case, the user is left to guess the location of the cutting edge when the conventional die is turned upside down so that the cutting edge thereof faces the sheet material and is invisible to the user. Consequently, a precise registration of the cutting edge of the conventional die with a pattern printed on the sheet material may not be easily achieved which may result in offset die cuts other than those which are intended.

Figure 9:
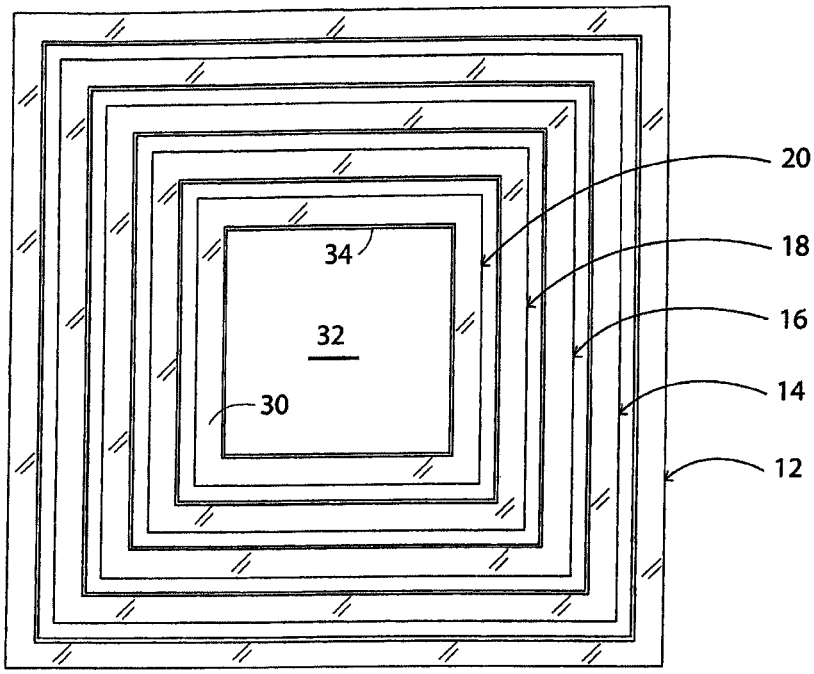
FIG. 9 shows a set of chemical-etched dies like that shown in FIG. 1 being nested one within the other.

Turning now to FIG. 9 of the drawings, there is shown a set of identical chemical-etched dies 12, 14, 16, 18 and 20 having successively smaller sizes so as to be capable of being nested one within the other. Each die (e.g., 20) of the set of dies of FIG. 9 has a square or rectangular configuration similar to the configuration of the die 1 of FIG. 1. However, the shape of die 20 and the remaining nested dies 12, 14, 16 and 18 is for the purpose of example only, and the die may have any other suitable shape. Each die (e.g., 20) has a flat outside border 30, an inside opening 32 around which the outside border 30 extends, and an outwardly projecting cutting edge 34 which lies at the interface of the outside border 30 with the inside opening 32 in the same manner as was previously described when referring to FIGS. 1-4.

The nested chemical-etched dies 12, 14, 16, 18 and 20 are shown in FIG. 9 being spaced from one another. Like the dies 1 and 3 of FIGS. 1 and 5, the set of nested dies can be formed by means of a conventional chemical etching process. However, all of the dies can be conveniently manufactured (i.e., etched) at the same time from a single sheet of flat steel. In this case, the sheet is etched to create the set of nested dies 12, 14, 16, 18 and 20 so that each successive die lies inside and is separated from a preceding die.

The invention claimed is:

1. A method for cutting out, by means of a first die, a shape that is printed on a sheet material, wherein the die includes an inside opening that corresponds to the shape to be cut from the sheet material, a flat outside border having first and opposite faces that surround said inside opening, and a cutting edge that projects from the first face of the flat outside border, such that said cutting edge surrounds the inside opening of said first die and corresponds exactly with the shape that is printed on the sheet material and none of the flat outside border of said die extends into the inside opening of said die past the interface of said cutting edge with the first face of said flat outer border, said method comprising the steps of:

locating the shape printed on the sheet material to be cut therefrom;

placing the cutting edge which projects from the first face of the flat outside border of said first die directly against the sheet material, and looking through the inside opening of said first die so that the shape printed on the sheet material is located entirely within the inside opening of said first die and the cutting edge which projects from the first face of said flat outside border is automatically registered so as to surround the shape to be cut from the sheet material;

positioning said first die and the sheet material having the shape to be cut therefrom within a roller press; and moving said first die and said sheet material through said roller press for causing a force to be applied to the opposite face of the flat outside border of said first die after said cutting edge has first been placed against the sheet material and said first die and said sheet material have been positioned in said roller press for pushing said cutting edge through said sheet material to cut the shape outwardly therefrom.

2. The method recited in claim 1, comprising the additional step of forming said first die by chemically etching a flat piece of metal.

3. The method recited in claim 2, comprising the additional step of forming at least a second die by chemically etching the flat piece of metal, such that the second die is nested within and spaced from the first die so as to lie at the inside opening of said first die, whereby the size of the inside opening of said first die is larger than said second die.

* * * * *